US009577311B2

(12) United States Patent
Back et al.

(10) Patent No.: US 9,577,311 B2
(45) Date of Patent: Feb. 21, 2017

(54) HF RESONATOR AND PARTICLE ACCELERATOR WITH HF RESONATOR

(75) Inventors: Michael Back, Erlangen (DE); Oliver Heid, Erlangen (DE); Michael Kleemann, Erlangen (DE)

(73) Assignee: Siemens Aktiengesellschaft, München (DE)

( * ) Notice: Subject to any disclaimer, the term of this patent is extended or adjusted under 35 U.S.C. 154(b) by 388 days.

(21) Appl. No.: 14/348,598

(22) PCT Filed: Sep. 5, 2012

(86) PCT No.: PCT/EP2012/067266

§ 371 (c)(1),
(2), (4) Date: Jul. 14, 2014

(87) PCT Pub. No.: WO2013/045236

PCT Pub. Date: Apr. 4, 2013

(65) Prior Publication Data

US 2014/0346949 A1 Nov. 27, 2014

(30) Foreign Application Priority Data

Sep. 29, 2011 (DE) ..... 10 2011 083 668

(51) Int. Cl.
*H05H 7/18* (2006.01)
*H01P 7/06* (2006.01)

(52) U.S. Cl.
CPC . *H01P 7/06* (2013.01); *H05H 7/18* (2013.01)

(58) Field of Classification Search
None
See application file for complete search history.

(56) References Cited

U.S. PATENT DOCUMENTS 4,633,180 A 12/1986 Biehl et al.
5,173,640 A 12/1992 Geisler et al.
(Continued)

FOREIGN PATENT DOCUMENTS

CN 1452852 A 10/2003
DE 3300767 C2 10/1991
(Continued)

OTHER PUBLICATIONS

French K D: "Development of a dielectric loaded RF cavity for a muon acceleraton", Nuclear Instruments & Methods in Physics Research, Section A: Accelerators, Spectrometers, Detectors and Associated Equipement, Elsevier BV, vol. 624, No. 3, pp. 731-734, XP002688958; 2010; Dec. 21, 2010.
(Continued)

*Primary Examiner* — Douglas W Owens
*Assistant Examiner* — Srinivas Sathiraju
(74) *Attorney, Agent, or Firm* — Lempia Summerfield Katz LLC

(57) ABSTRACT

The invention relates to an HF resonator comprising a cylindrical cavity made of a dielectric material. An inner face of the cavity has an electrically conductive coating which is divided into a first inner coating and a second inner coating by an electrically insulating gap that encircles a lateral face of the cavity in an annular manner. An outer face of the cavity has an electrically conductive first outer coating and an electrically conductive second outer coating. The first outer coating and the second outer coating are electrically insulated from each other. The HF resonator comprises a device that is provided for applying a high-frequency electric voltage between the first outer coating and the second outer coating.

20 Claims, 1 Drawing Sheet

(56) References Cited

U.S. PATENT DOCUMENTS

| | | | | |
|---|---|---|---|---|
| 5,532,210 | A | 7/1996 | Shen | |
| 6,417,499 | B2 | 7/2002 | Blaker et al. | |
| 9,130,504 | B2 * | 9/2015 | Back | H05H 7/18 |
| 2002/0003141 | A1 | 1/2002 | Blaker et al. | |
| 2002/0093401 | A1 | 7/2002 | Chiu et al. | |
| 2004/0143099 | A1 * | 7/2004 | Petersen | A61K 38/4846 530/383 |
| 2004/0198660 | A1 * | 10/2004 | Petersen | A61K 38/4846 514/1.4 |
| 2008/0172272 | A1 * | 7/2008 | Back | G06Q 10/06 705/7.36 |
| 2010/0161361 | A1 * | 6/2010 | Spears | G06Q 30/0201 705/7.29 |
| 2011/0099424 | A1 * | 4/2011 | Rivera Trevino | G06F 11/263 714/25 |
| 2011/0220413 | A1 * | 9/2011 | Suhm | E21B 7/00 175/57 |
| 2011/0318492 | A1 * | 12/2011 | Nadrchal | B41F 23/08 427/265 |
| 2012/0133306 | A1 | 5/2012 | Seliger et al. | |
| 2012/0229054 | A1 | 9/2012 | Baurichter et al. | |
| 2014/0346949 | A1 * | 11/2014 | Back | H01P 7/06 315/39 |
| 2015/0042244 | A1 * | 2/2015 | Back | H05H 7/18 315/500 |

FOREIGN PATENT DOCUMENTS

| | | | |
|---|---|---|---|
| DE | 102009036418 | A1 | 2/2011 |
| DE | 102009053624 | A1 | 5/2011 |
| EP | 0606870 | A1 | 7/1994 |
| JP | 10501366 | A | 2/1998 |
| JP | 2003303700 | A | 10/2003 |
| WO | WO2011061026 | A1 | 5/2011 |

OTHER PUBLICATIONS

German Office Action for German Application No. 10 2011 083 668.3, mailed May 22, 2012, with English Translation.

M. Popovic er al.: "Dielectric Loaded RF Cavities for Muon Facilities", Proceedings IPAC '10, Kyoto Japan, Jun. 2010 (Jun. 2006), pp. 3783-3785, XP002688956.

M. Popovic et al. "Compact, Tunable RF Cavities", Proceedings EPAC 08 Genoa, Italy, Jul. 2008 (Jul. 2008), pp. 802-804, XP002688957.

O. Held und T. Hughes, "Compact Solid State Direct Drive RF Linac", Proceedings of IPAC 2010, Kyoto, Japan p. 4278.

PCT International Search Report and Written Opinion of the International Searching Authority dated Jan. 4, 2013 for corresponding PCT/EP2012/067266.

Japanese Notice of Allowance for related Application No. 2014-532303, dated Apr. 24, 2015.

Chinese Office action for related Chinese Application No. 2012800570038, dated Sep. 9, 2015, with English Translation.

French K. D.: Development of a Dielectric Loaded RF Cavity for a Muon Accelerator, Nuclear Instrument & Methods in Physics, vol. 624, No. 3., p. 1-13.

* cited by examiner

HF RESONATOR AND PARTICLE ACCELERATOR WITH HF RESONATOR

This application is the National Stage of International Application No. PCT/EP2012/067266, filed Sep. 5, 2012, which claims the benefit of German Patent Application No. DE 10 2011 083 668.3, filed Sep. 29, 2011. The entire contents of these documents are hereby incorporated herein by reference.

BACKGROUND

The present embodiments relate to a radio frequency (RF) resonator.

Radio-frequency electromagnetic oscillations may be excited in RF resonators. RF resonators may also be designated as cavity resonators. RF resonators are used, for example, in particle accelerators for accelerating electrically charged particles.

In order to excite a radio-frequency electromagnetic oscillation in an RF resonator, it is known to generate a radio-frequency power using a klystron or a tetrode, for example, and to transport the power by a cable or a waveguide to the RF resonator and to couple the power into the RF resonator at the RF resonator via a radiation window or an RF antenna. However, very high RF powers may not be obtained with this type of excitation.

EP 0 606 870 A1 discloses equipping an RF resonator with a conductive wall with a plurality of solid-state transistors for inducing a radio-frequency electric current flow in the wall of the RF resonator and thereby exciting a radio-frequency electromagnetic oscillation in the RF resonator. The excitation of the current flow takes place by the application of a radio-frequency electrical voltage via an electrically insulating slot in the wall of the RF resonator.

Use of RF resonators in particle accelerators for accelerating electrically charged particles includes evacuation of the RF resonator to a very low pressure. Electrically insulating slots filled with dielectric material in otherwise conductive walls of an RF resonator may be sealed only with difficulty and in a complex manner.

SUMMARY AND DESCRIPTION

The scope of the present invention is defined solely by the appended claims and is not affected to any degree by the statements within this summary.

The present embodiments may obviate one or more of the drawbacks or limitations in the related art. For example, an RF resonator that may be better evacuated is provided.

An RF resonator includes a cylindrical cavity composed of a dielectric material. An inner side of the cavity has an electrically conductive coating that is subdivided into a first inner coating and a second inner coating by an electrically insulating gap extending circumferentially around a lateral surface of the cavity in ring-shaped fashion. An outer side of the cavity has an electrically conductive first outer coating and an electrically conductive second outer coating. The first outer coating and the second outer coating are electrically insulated from one another. The RF resonator includes a device provided for applying a radio-frequency electrical voltage between the first outer coating and the second outer coating. Advantageously, the cylindrical cavity of this RF resonator may be evacuated in a simple manner and does not have any perforations that are problematic to seal (e.g., any metal-ceramic connections that are difficult to seal). Advantageously, the device of the RF resonator may capacitively excite a radio-frequency electromagnetic oscillation in the RF resonator via the conductive outer and inner coatings.

In one embodiment of the RF resonator, the gap extending circumferentially in ring-shaped fashion is oriented perpendicularly to a longitudinal direction of the cylindrical cavity. Advantageously, the RF resonator has a mirror symmetry and rotational symmetry, which enables an excitation of symmetrical oscillation modes.

In another embodiment of the RF resonator, the first outer coating and the second outer coating each extend circumferentially around the lateral surface of the cavity in ring-shaped fashion. Advantageously, the outer side of the RF resonator then also has a mirror symmetry and rotational symmetry, which enables an excitation of symmetrical oscillation modes.

The first outer coating may be adjacent to the first inner coating in a direction oriented perpendicularly to the lateral surface of the cavity. Advantageously, there is then a strong capacitive coupling between the first outer coating and the first inner coating.

The second outer coating may be adjacent to the second inner coating in a direction oriented perpendicularly to the lateral surface of the cavity. Advantageously, there is then a high capacitive coupling between the second outer coating and the second inner coating.

In one development of the RF resonator, the device includes a solid-state power transistor. Advantageously, with a solid-state power transistor, the RF power to be coupled into the RF resonator may be generated close to the coupling-in location.

In one development of the RF resonator, the device includes a plurality of solid-state power transistors arranged around the lateral surface of the cavity in ring-shaped shaped fashion. Advantageously, the provision of a plurality of solid-state power transistors enables the excitation of a particularly high RF power in the RF resonator.

In one embodiment of the RF resonator, the dielectric material is a glass or a ceramic. Advantageously, glass and ceramic have mechanical properties suitable for use as a vacuum vessel.

The cavity may have a circular-cylindrical shape. Advantageously, a cavity embodied in circular-cylindrical fashion enables an excitation of oscillation modes suitable for accelerating charged particles.

In one embodiment, the cavity is configured to be evacuated to a reduced air pressure compared with the surroundings of the cavity. Advantageously, the RF resonator may be used for accelerating electrically charged particles.

A particle accelerator according to one or more of the present embodiments for accelerating electrically charged particles includes an RF resonator of the type mentioned above. Advantageously, the RF resonator in this particle accelerator may be evacuated to a low pressure and has no seams that are difficult to seal.

DETAILED DESCRIPTION

Figure 1:
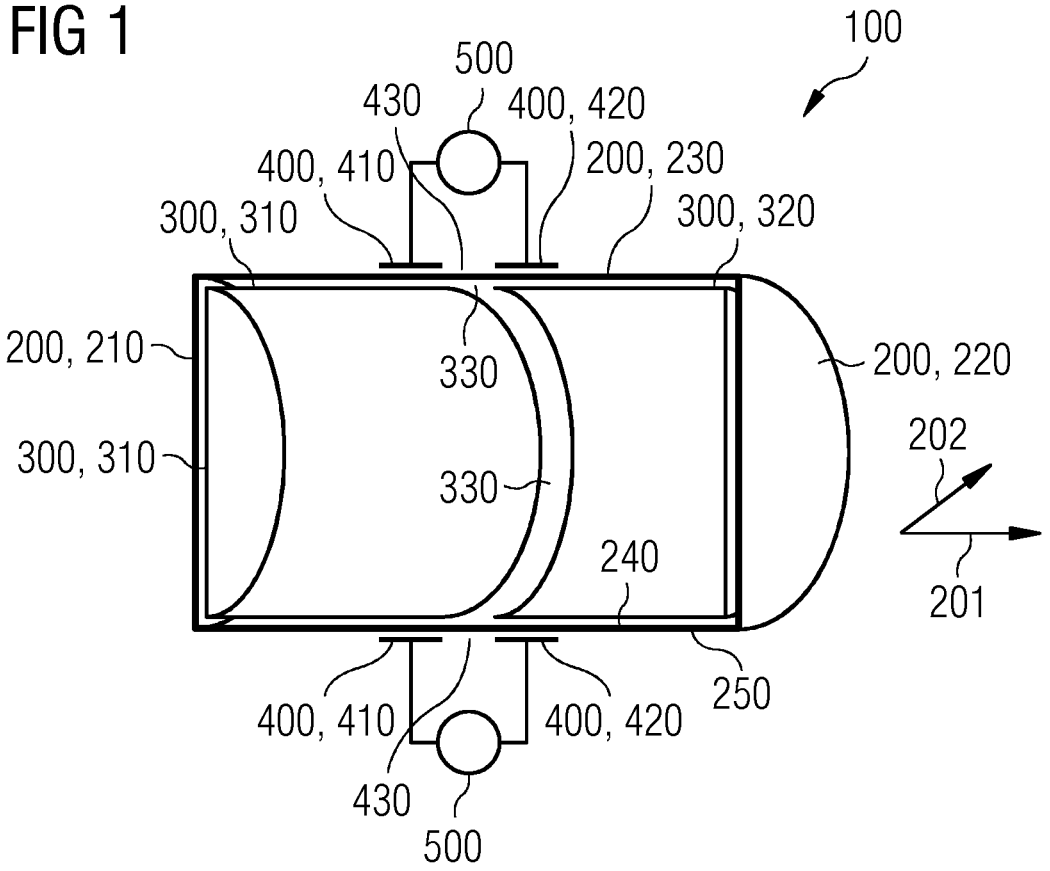
FIG. 1 shows a section through one embodiment of an RF resonator.

FIG. 1 shows one embodiment of an RF resonator 100 in a highly schematic illustration. A radio-frequency electromagnetic oscillation mode may be excited in the RF resonator 100. The RF resonator 100 may serve, for example, for accelerating electrically charged particles in a particle accelerator.

The RF resonator 100 includes a cavity 200. The cavity 200 is embodied as a hollow cylinder and has a circular-disk-shaped first cover surface 210, a circular-disk-shaped second cover surface 220 and a lateral surface 230 connecting the first cover surface 210 to the second cover surface 220. In the illustration in FIG. 1, the cavity 200 is cut on the plane of the drawing. Consequently, FIG. 1 illustrates only one half of the cavity 200.

The cavity 200 embodied in hollow-cylindrical fashion defines a longitudinal direction 201 and a radial direction 202 that is oriented perpendicularly to the longitudinal direction 201. The first cover surface 210 and the second cover surface 220 are each oriented perpendicularly to the longitudinal direction 201. The lateral surface 230 of the cavity 200 extends between the first cover surface 210 and the second cover surface 220 along the longitudinal direction 201.

In alternative embodiments, the first cover surface 210 and the second cover surface 220 may also be embodied differently than in circular-disk-shaped fashion. By way of example, the cover surfaces 210, 220 may each have a rectangular shape or an elliptical shape.

The cavity 200 consists of an electrically insulating dielectric material. In one embodiment, the cavity 200 consists of a glass or a ceramic. Advantageously, glass and ceramic materials are strong enough to withstand a high pressure difference between an interior of the cavity 200 and the surroundings of the cavity 200.

The cavity 200 of the RF resonator 100 completely encloses a hollow space and may have no seams that are difficult to seal. Also, the cavity 200 of the RF resonator 10 may have no metal-ceramic transitions. This enables the cavity 200 to be evacuated to a reduced pressure compared with an air pressure in the surroundings of the cavity 200. For the purpose of evacuating the cavity 200, the cavity 200 may have one or a plurality of suitable flanges. The first cover surface 210 and the second cover surface 220 of the cavity 200 may also have suitable openings or windows through which a beam of charged particles may pass into the interior of the cavity 200 and may exit from the interior of the cavity 200.

The cavity 200 has an inner side 240 facing the hollow space enclosed by the cavity 200. The cavity 200 has an outer side 250 facing the surroundings of the cavity 200.

An electrically conductive inner coating 300 is arranged on the inner side 240 of the cavity 200. The electrically conductive inner coating 300 may include a metal, for example. The inner coating 300 is subdivided into a first inner coating 310 and a second inner coating 320. An electrically insulating inner gap 330 is arranged between the first inner coating 310 and the second inner coating 320. The inner gap electrically insulates the first inner coating 310 from the second inner coating 320. In the region of the inner gap 330, no conductive coating is provided on the inner side 240 of the cavity 200.

In one embodiment, the inner gap 330 is arranged in a manner extending circumferentially on the lateral surface 230 of the cavity 200 in ring-shaped fashion. In this case, the inner gap 330 may be oriented perpendicularly to the longitudinal direction 201 of the cavity 200 and thus parallel to the cover surfaces 210, 220. In one embodiment, the inner gap 330 is arranged centrally between the first cover surface 210 and the second cover surface 220.

The first inner coating 310 covers the inner side 240 of the first cover surface 210 and the inner side 240 of a portion of the lateral surface 230 that is adjacent to the first cover surface 210. The second inner coating 320 covers the inner side 240 of the second cover surface 220 and the inner side 240 of a portion of the lateral surface 230 that is adjacent to the second cover surface 220.

In the longitudinal direction 201, the inner gap 330 may be made very narrow. For example, the width of the inner gap 330 in the longitudinal direction 201 may be small compared with a length of the cavity 200 in the longitudinal direction 201 and small compared with a wavelength of a radio-frequency oscillation mode that may be excited in the RF resonator 100.

An electrically conductive outer coating 400 is arranged on the outer side 250 of the cavity 200. The outer coating 400 may consist of a metal, for example. The outer coating 400 includes a first outer coating 410 and a second outer coating 420. An outer gap 430 is arranged between the first outer coating 410 and the second outer coating 420. In the region of the outer gap 430, no electrically conductive coating is provided on the outer side 250 of the cavity 200. The outer gap 430 electrically insulates the first outer coating 410 and the second outer coating 420 from one another.

Figure 2:
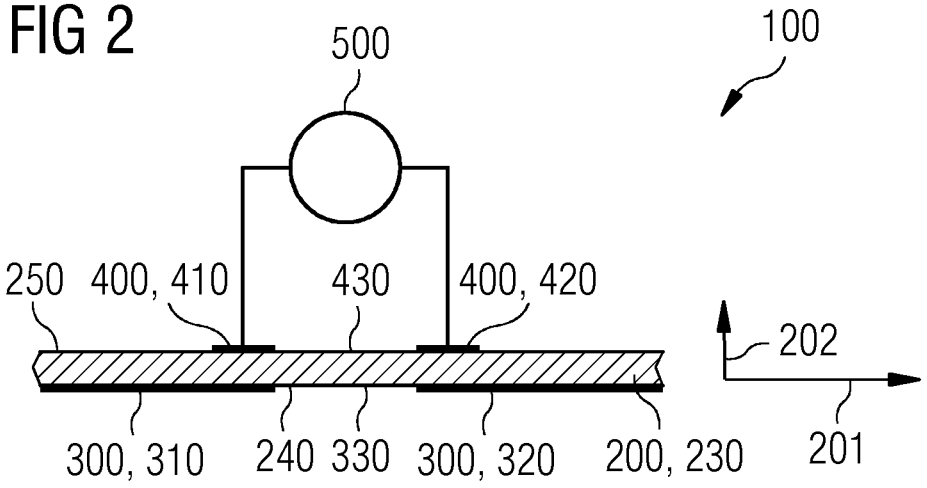
FIG. 2 shows a section through a wall portion of one embodiment of the RF resonator.

FIG. 2 shows a section through a portion of the lateral surface 230 of the cavity 200 of the RF resonator 100 in the region of the inner gap 330 and of the outer gap 430. The outer gap 430 is situated at the same position as the inner gap 330 in the longitudinal direction 201. In the radial direction 202, the outer gap 430 is adjacent to the inner gap 330. The outer gap 430 is arranged on the outer side 250 of the lateral surface 230 in a manner extending circumferentially in a ring-shaped fashion. If the inner gap 330 is situated in the center between the first cover surface 210 and the second cover surface 220 in the longitudinal direction 201 of the cavity 200, then the outer gap 430 may also be arranged centrally between the first cover surface 210 and the second cover surface 220. The width of the outer gap 430 in the longitudinal direction 201 may substantially correspond to the width of the inner gap 330 in the longitudinal direction 201.

The first outer coating 410 and the second outer coating 420 are each arranged on the outer side 250 of the lateral surface 230 in a manner extending circumferentially in ring-shaped fashion. In this case, the outer coatings 410, 420 embodied in ring-shaped fashion may be oriented perpendicularly to the longitudinal direction 201 of the cavity 200. The width of the first outer coating 410 in the longitudinal direction 201 and the width of the second outer coating 420 in the longitudinal direction 201 may correspond approximately to the width of the outer gap 430 in the longitudinal direction 201 of the cavity 200. The first outer coating 410 and the second outer coating 420 may also have a larger width or a smaller width than the outer gap 430 in the longitudinal direction 201. In one embodiment, the width of the first and second outer coatings 410, 420 in the longitudinal direction 201 is small relative to a wavelength of an electromagnetic oscillation mode that may be excited in the cavity 200.

The first outer coating 410 is insulated from the first inner coating 310 by the dielectric lateral surface 230. The second outer coating 420 is insulated from the second inner coating 320 by the dielectric lateral surface 230. The first inner coating 410, the dielectric lateral surface 230 and the first inner coating 310 form a first capacitor. The second outer coating 420, the dielectric lateral surface 230 and the second inner coating 320 form a second capacitor. The first and second capacitors bring about a capacitive coupling between the first outer coating 410 and the first inner coating 310 and between the second outer coating 420 and the second inner coating 320. An electrical voltage applied between the first outer coating 410 and the second outer coating 420 is coupled capacitively into the first inner coating 310 and the second inner coating 320, such that an electrical voltage applied between the first outer coating 410 and the second outer coating 420 brings about a substantially identical electrical voltage between the first inner coating 310 and the second inner coating 320.

The RF resonator 100 includes a drive device 500 that is provided for coupling radio-frequency electromagnetic power into the cavity 200 of the RF resonator 100. The drive device 500 is configured to apply a radio-frequency electrical voltage between the first outer coating 410 and the second outer coating 420. The drive device 500 may include a solid-state power transistor or some other solid-state switch. In one embodiment, the drive device 500 includes a plurality of solid-state power transistors arranged in a ring-shaped manner in the region of the outer gap 430 in a manner extending circumferentially on the outer side 250 of the lateral surface 230 of the cavity 200.

If the drive device 500 applies a radio-frequency electrical AC voltage between the first outer coating 410 and the second outer coating 420, then a radio-frequency electrical AC voltage also occurs between the first inner coating 310 and the second inner coating 320 owing to the capacitive couplings between the outer coatings 410, 420 and the inner coatings 310, 320. In the first inner coating 310 and the second inner coating 320, the radio-frequency electrical voltage coupled in excites a radio-frequency electric current flow.

If the frequency of the AC voltage applied by the drive device 500 between the first outer coating 410 and the second outer coating 420 corresponds to a resonant frequency of the RF resonator 100, then the current flow induced in the inner coatings 310, 320 brings about an excitation of a resonant radio-frequency oscillation mode in the interior of the cavity 200.

Consequently, the drive device 500 allows radio-frequency electromagnetic power to be coupled capacitively into the cavity 200 of the RF resonator 100, in order to excite and amplify a resonant radio-frequency oscillation in the interior of the cavity 200.

Advantageously, the cavity 200 of the RF resonator 100 simultaneously serves as a vessel to be evacuated and as a carrier for the electrically conductive inner coating 300. By virtue of the possibility of a capacitive excitation, the cavity 200 does not require any electrically conductive perforations and therefore also does not require any metal-ceramic transitions that are difficult to seal.

Although the invention has been more specifically illustrated and described in detail by the exemplary embodiments, the invention is not restricted by the examples disclosed. Other variations may be derived therefrom by a person skilled in the art, without departing from the scope of protection of the invention.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding or following claim, whether independent or dependent, and that such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. An RF resonator comprising:

a cylindrical cavity composed of a dielectric material, wherein an inner side of the cylindrical cavity has an electrically conductive coating that is subdivided into a first inner coating and a second inner coating by an electrically insulating gap extending circumferentially around a lateral surface of the cylindrical cavity in ring-shaped fashion, wherein an outer side of the cylindrical cavity has an electrically conductive first outer coating and an electrically conductive second outer coating, and wherein the first outer coating and the second outer coating are electrically insulated from one another; and a device configured to apply a radio-frequency electrical voltage between the first outer coating and the second outer coating.

2. The RF resonator of claim 1, wherein the electrically insulating gap extending circumferentially in a ring-shaped fashion is oriented perpendicularly to a longitudinal direction of the cylindrical cavity.

3. The RF resonator of claim 1, wherein the first outer coating and the second outer coating each extend circumferentially around the lateral surface of the cylindrical cavity in ring-shaped fashion.

4. The RF resonator of claim 1, wherein the first outer coating is adjacent to the first inner coating in a direction oriented perpendicularly to the lateral surface of the cylindrical cavity.

5. The RF resonator of claim 1, wherein the second outer coating is adjacent to the second inner coating in a direction oriented perpendicularly to the lateral surface of the cylindrical cavity.

6. The RF resonator of claim 1, wherein the device comprises a solid-state power transistor.

7. The RF resonator of claim 6, wherein the device comprises a plurality of solid-state power transistors arranged in ring-shaped fashion around the lateral surface of the cylindrical cavity, the plurality of solid-state power transistors comprising the solid-state power transistor.

8. The RF resonator of claim 1, wherein the dielectric material is a glass or a ceramic.

9. The RF resonator of claim 1, wherein the cylindrical cavity has a circular-cylindrical shape.

10. The RF resonator of claim 1, wherein the cylindrical cavity is evacuatable to a reduced air pressure compared with surroundings of the cylindrical cavity.

11. A particle accelerator for accelerating electrically charged particles, the particle accelerator comprising:

an RF resonator comprising:

a cylindrical cavity composed of a dielectric material, wherein an inner side of the cylindrical cavity has an electrically conductive coating that is subdivided into a first inner coating and a second inner coating by an electrically insulating gap extending circumferentially around a lateral surface of the cylindrical cavity in ring-shaped fashion, wherein an outer side of the cylindrical cavity has an electrically conductive first outer coating and an electrically conductive second outer coating, and wherein the first outer coating and the second outer coating are electrically insulated from one another; and a device configured to apply a radio-frequency electrical voltage between the first outer coating and the second outer coating.

12. The particle accelerator of claim 11, wherein the electrically insulating gap extending circumferentially in a ring-shaped fashion is oriented perpendicularly to a longitudinal direction of the cylindrical cavity.

13. The particle accelerator of claim 11, wherein the first outer coating and the second outer coating each extend circumferentially around the lateral surface of the cylindrical cavity in ring-shaped fashion.

14. The particle accelerator of claim 11, wherein the first outer coating is adjacent to the first inner coating in a direction oriented perpendicularly to the lateral surface of the cylindrical cavity.

15. The particle accelerator of claim 11, wherein the second outer coating is adjacent to the second inner coating in a direction oriented perpendicularly to the lateral surface of the cylindrical cavity.

16. The particle accelerator of claim 11, wherein the device comprises a solid-state power transistor.

17. The particle accelerator of claim 16, wherein the device comprises a plurality of solid-state power transistors arranged in ring-shaped fashion around the lateral surface of the cylindrical cavity, the plurality of solid-state power transistors comprising the solid-state power transistor.

18. The particle accelerator of claim 11, wherein the dielectric material is a glass or a ceramic.

19. The particle accelerator of claim 11, wherein the cylindrical cavity has a circular-cylindrical shape.

20. The particle accelerator of claim 11, wherein the cylindrical cavity is evacuatable to a reduced air pressure compared with surroundings of the cylindrical cavity.

* * * * *